US011214418B2

(12) United States Patent
Lin

(10) Patent No.: US 11,214,418 B2
(45) Date of Patent: Jan. 4, 2022

(54) SEAL COVER

(71) Applicant: XIAMEN DEGUAN TECHNOLOGY CO., LTD., Xiamen (CN)

(72) Inventor: Manfan Lin, Xiamen (CN)

(73) Assignee: XIAMEN DEGUAN TECHNOLOGY CO., LTD., Xiamen (CN)

( * ) Notice: Subject to any disclaimer, the term of this patent is extended or adjusted under 35 U.S.C. 154(b) by 339 days.

(21) Appl. No.: 16/468,295

(22) PCT Filed: Sep. 30, 2018

(86) PCT No.: PCT/CN2018/109026
§ 371 (c)(1),
(2) Date: Jun. 11, 2019

(87) PCT Pub. No.: WO2020/000754
PCT Pub. Date: Jan. 2, 2020

(65) Prior Publication Data

US 2021/0002045 A1 Jan. 7, 2021

(30) Foreign Application Priority Data

Jun. 25, 2018 (CN) ..... 201820983534.4

(51) Int. Cl.
*B65D 51/18* (2006.01)
*B65D 47/12* (2006.01)
(Continued)

(52) U.S. Cl.
CPC ..... *B65D 51/18* (2013.01); *B65D 41/0471* (2013.01); *B65D 47/122* (2013.01); *B65D 75/5883* (2013.01); *B65D 2251/20* (2013.01)

(58) Field of Classification Search
CPC ..... B65D 51/18; B65D 41/0471; B65D 75/5883; B65D 47/122; B65D 2251/20
(Continued)

(56) References Cited

U.S. PATENT DOCUMENTS 6,338,414 B1 * 1/2002 Schellenbach ..... B65D 41/0421 215/252
8,365,933 B2 * 2/2013 Jackel ..... B65D 47/0838 215/318
(Continued)

FOREIGN PATENT DOCUMENTS

AU 2018100893 A4 8/2018
CN 102627165 A 8/2012
(Continued)

*Primary Examiner* — James N Smalley
(74) *Attorney, Agent, or Firm* — Bayramoglu Law Offices LLC

(57) ABSTRACT

A seal cover for sealing a filling tube of a container, includes a cover wall and a cover plate. An outer wall of the filling tube is provided with external threads; the seal cover includes an inner cover body and an outer cover body; the cover wall encloses a barrel structure, with one end sealed by the cover plate, and the other end being an open end; an inner surface of the cover wall is provided with internal threads matched with the external threads of the filling tube; a boss is formed on an end face of the open end of the inner cover body; the filling tube is provided with a wedge block; the external threads of the filling tube and the internal threads of the inner cover body are screwed with each other.

17 Claims, 7 Drawing Sheets

(51) Int. Cl.
*B65D 75/58* (2006.01)
*B65D 41/04* (2006.01)

(58) Field of Classification Search
USPC ..... 215/330, 331
See application file for complete search history.

(56) References Cited

U.S. PATENT DOCUMENTS

| | | | | |
|---|---|---|---|---|
| 2004/0200797 | A1* | 10/2004 | Hicks | B65D 41/0421 215/305 |
| 2013/0341329 | A1* | 12/2013 | Adler | G09F 3/10 220/288 |
| 2015/0166219 | A1* | 6/2015 | Bailey | B65D 41/0471 215/253 |

FOREIGN PATENT DOCUMENTS

| | | | |
|---|---|---|---|
| CN | 103112656 | A | 5/2013 |
| CN | 204223432 | U | 3/2015 |
| JP | 2016033043 | A | 3/2016 |
| JP | 2017190172 | A | 10/2017 |

* cited by examiner

SEAL COVER

CROSS REFERENCE TO THE RELATED APPLICATIONS

This application is the national phase entry of International Application No. PCT/CN2018/109026, filed on Sep. 30, 2018, which is based upon and claims priority to Chinese Patent Application No. 201820983534.4, filed on Jun. 25, 2018, the entire contents of which are incorporated herein by reference.

TECHNICAL FIELD

The present invention relates to a seal cover for sealing a filling tube of a container.

BACKGROUND

Currently, a hermetic container for storing material is usually provided with a filling tube to facilitate filling and pouring out the material. If the hermetic container is a flexible packaging bag for containing fluid food such as juice, milk or drinkable jelly, the filling tube can also be used as a straw. To facilitate storage of material, generally a seal cover is arranged at a tube opening of the filling tube, with external threads formed an outer wall of the filling tube and also threads on an inner wall of the seal cover, and the seal cover is installed on the tube opening of the filling tube through threaded connection between the seal cover and the filling tube, thus effectively protect the material within the container.

The installation process of the seal cover produced by an existing manufacturer is as follows: first, an open end of the seal cover is sleeved on the tube opening of the filling tube, then the seal cover is rotated so that the threads on its inner wall is screwed with the threads on the outer wall of the filling tube, until a wall end face of the filling tube abuts against a closed end of the seal cover to stop rotation, thus achieving sealing of the tube opening of the filling tube by the seal cover. However, as it is difficult to accurately determine whether the filling tube and the seal cover are screwed tightly with each other, the seal cover is likely to be not screwed in place, resulting in poor sealing between the filling tube and the seal cover, so that they are liable to loosen and release from each other due to external vibration; the seal cover is also likely to be further rotated after arriving at a tightly screwed position, so that the filling tube moves deeper in the seal cover, which causes the wall end face of the filling tube to act on an inner surface of the closed end of the seal cover to generate friction therebetween, such that the seal cover is deformed or damage, also resulting in seal failure. In addition, the torsion for rotating the seal cover often has a deviation range, and a very large torsion is liable to cause cracking of the part of the seal cover in contact with the filling tube due to poor tolerance.

SUMMARY

To solve the above-mentioned shortcomings and drawbacks in the prior art, the present invention provides a seal cover, by means of which accurate screwing between the seal cover and a filling tube can be achieved, cracking and damage of the seal cover or loosening and release of the seal cover from the filling tube is avoided, and the sealing reliability is improved.

A technical solution adopted in the present invention is as follows:

A seal cover for sealing a tube opening of a filling tube is provided, wherein an outer wall of the filling tube is provided with external threads; the seal cover includes an inner cover body and an outer cover body;

the inner cover body includes a cover wall and a cover plate, the cover wall enclosing a barrel structure, with one end sealed by the cover plate, and the other end being an open end; an inner surface of the cover wall is provided with internal threads matched with the external threads of the filling tube; a boss is formed on an end face of the open end of the inner cover body, the boss being formed by a cross section, and an oblique surface and a step surface which are adjoined with the cross section respectively, the cross section being perpendicular to the cover plate and running through the wall thickness of the cover wall, the oblique surface being tilted toward a direction away from the cover plate, and the step surface protruding from the oblique surface; the outer cover body is a barrel structure, and is sleeved at the outer periphery of the inner cover body and connected with the inner cover body;

the filling tube is provided with a wedge block, and the external threads on the outer wall of the filling tube are located between the tube opening and the wedge block; the wedge block is formed by an arc surface and a section adjoined with the arc surface, wherein an arc mouth of the arc surface faces away from the tube opening of the filling tube, and the section is perpendicular to the outer wall of the filling tube;

the external threads of the filling tube and the internal threads of the inner cover body are screwed with each other until the section of the wedge block is fit to and blocked by the cross section of the boss, and the arc surface of the wedge block is closely fit to the oblique surface of the boss, thus completing sealing of the tube opening of the filling tube by the inner cover body.

The seal cover of the present invention is provided with the boss cooperating with the wedge block of the filling tube, and the oblique surface and cross section that form the boss are designed to form a V-shaped included angle. When the seal cover is screwed in place on the filling tube, the cross section of the boss blocks the section of the wedge block, and the oblique surface of the boss and the arc surface of the wedge block clamp each other to produce an obvious sense of setback; and when the seal cover is being unscrewed from the filling tube, the oblique surface of the boss separates from the arc surface of the wedge block to produce an obvious sense of loosening and release. Thus, the boss can serve to implement loosening and tightening functions at fixed points, to achieve the effect of indicating whether the seal cover is screwed tightly with or unscrewed from the filling tube, thereby facilitating a person or equipment accurately determining the position of the seal cover on the filling tube, avoiding the seal cover is not screwed in place, and also avoiding the seal cover is further rotated after arriving at a tightly screwed position; and in this way, the seal cover can be precisely screwed with the filling tube through the threads, and the sealing effect is ensured.

Second, after the seal cover is screwed tightly with the filling tube, the oblique surface of the boss and the arc surface of the wedge block clamp each other, so it can prevent the filling tube from withdrawing from the seal cover under the action of an external force, avoid the seal cover and the filling tube are gradually unscrewed and released from each other due to external vibration, thus improving the sealing reliability.

Furthermore, the cross section of the boss of the seal cover and the section of the wedge block of the filling tube abut against each other, so that the seal cover cannot be further rotated after arriving at the tightly screwed position, thereby overcoming a negative effect caused by torsion deviation. Although the magnitude of the torsion for rotating the seal cover may be different, it can ensure that the seal cover is screwed to the same tightly screwed position, thus improving the accuracy of screwing of the seal cover and the filling tube, and preventing cracking of the seal cover due to the action of the filling tube on the seal cover.

Further, at the center of an inner surface of the cover plate of the inner cover body is provided a plug which protrudes from the inner surface; and when the inner cover body is sealed at the tube opening of the filling tube, the plug is embedded in the tube opening of the filling tube to form a seal structure. Providing the plug can further improve the sealing effect and more effectively protect the material within the container.

Further, when the inner cover body is sealed at the tube opening of the filling tube, the plug is embedded in the tube opening of the filling tube to form a seal structure, and the plug and the tube opening of the filling tube are in interference fit to achieve a good sealing effect.

Further, when the inner cover body is sealed at the tube opening of the filling tube, a clearance is present between the inner surface of the cover plate and the wall end face of the filling tube, and the inner cover body has an air pressure due to a small amount of gas retained therein, thereby reducing the acting force for resisting the external atmospheric pressure when unscrewing the filling tube.

Further, at least one convex point is provided around the plug in the inner surface of the cover plate. The convex point can block the wall end face of the filling tube, to avoid the wall end face of the filling tube directly acts on the inner surface of the cover plate, thereby preventing deformation or damage of the cover plate.

Further, the seal cover further includes an anti-theft ring sleeved at the outer periphery of the open end of the inner cover body, and the anti-theft ring is connected with the open end of the inner cover body and goes beyond the outer cover body. With the definition here, the seal cover has an anti-theft function.

Further, the inner cover body and the outer cover body are connected with each other through at least two connecting pieces, and the anti-theft ring is connected to each connecting piece.

Further, each connecting piece is composed of an arc segment and a straight segment which are formed in one piece; opposite to an end of the arc segment connected with the straight segment, the other end of the arc segment is connected with the inner cover body; opposite to an end of the straight segment connected with the arc segment, the other end of the straight segment is connected with the outer cover body; and the intersection point of extension lines of all the connecting pieces is located on the axis of the inner cover body. With the definition of the structure of the connecting pieces here, it is conducive to improving the stability of connection between the inner cover body and the outer cover body, and increasing the balance of the entire seal cover structure.

Compared with a flat and straight connecting piece in an existing seal cover, the connecting piece in the seal cover of the present invention is composed of the arc segment and the straight segment, so that the seal cover can have special, attractive appearance on the one hand, and it can also achieve a guiding function on the other hand, to facilitate insertion of a rotating head of a filling and capping machine into the space between the inner cover body and the outer cover body during packaging.

Further, the anti-theft ring is connected to the junction between the arc segment and the straight segment of each connecting piece. With the definition here, it is conducive to improving the stability of connection between the anti-theft ring and the inner cover body, and increasing the balance of the entire seal cover structure.

Further, an outer wall surface of the outer cover body is provided with continuous regular-hexagon patterns. The regular-hexagon patterns can on the one hand improve the attractive appearance of the seal cover, and can on the other hand increase the roughness of the outer wall surface of the outer cover body and the friction between a hand and the outer cover body when rotating the seal cover to avoid slipping of the hand.

For the sake of better understanding and implementation, the present invention is described in detail below in conjunction with the accompanying drawings.

DETAILED DESCRIPTION OF THE EMBODIMENTS

The present invention provides a seal cover for sealing a filling tube of a container.

Figure 1:
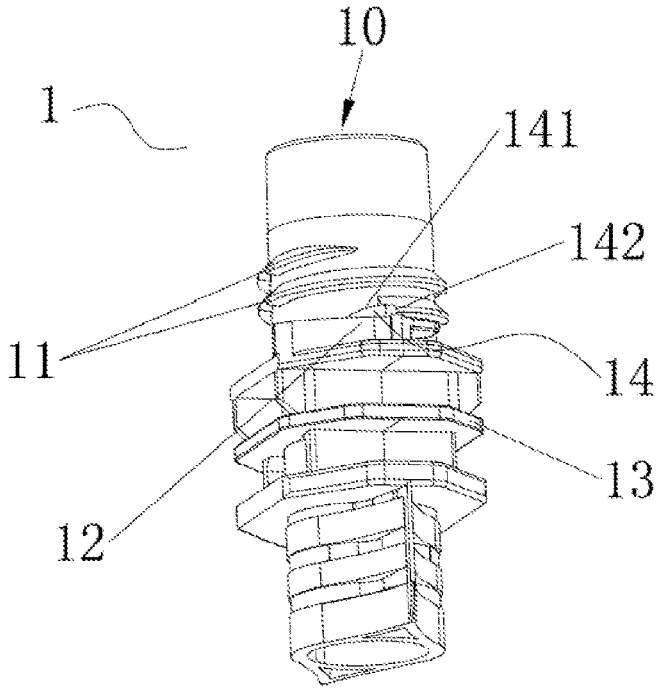
FIG. 1 is a three-dimensional structure diagram of a filling tube.
Figure 2:
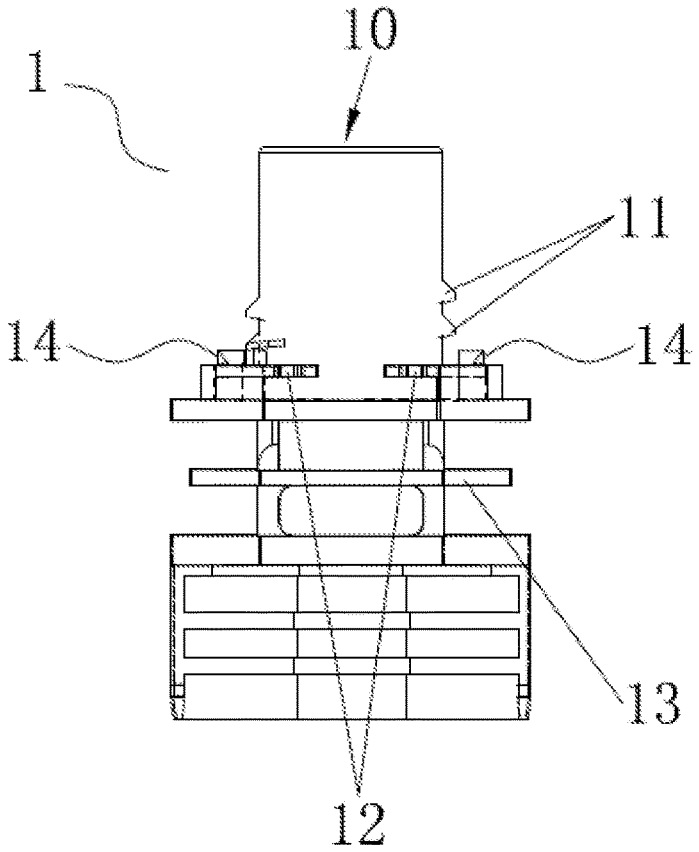
FIG. 2 is a front view of the filling tube.
Figure 3:
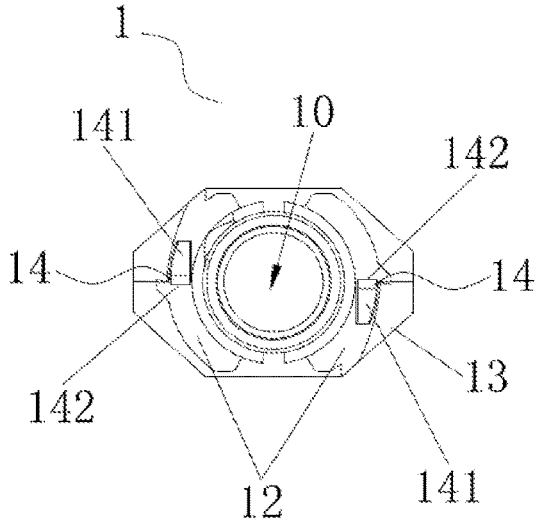
FIG. 3 is a top view of the filling tube.
Figure 4:
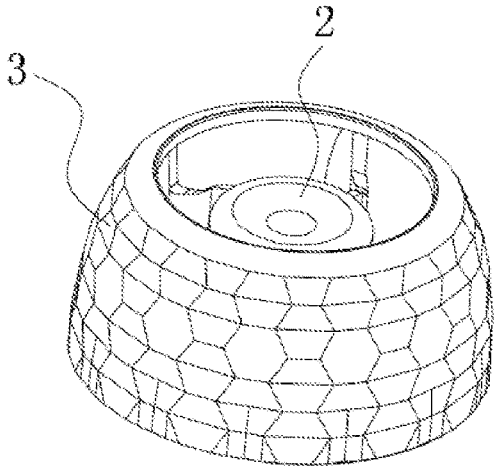
FIG. 4 is a three-dimensional structure diagram of a seal cover of the present invention.
Figure 5:
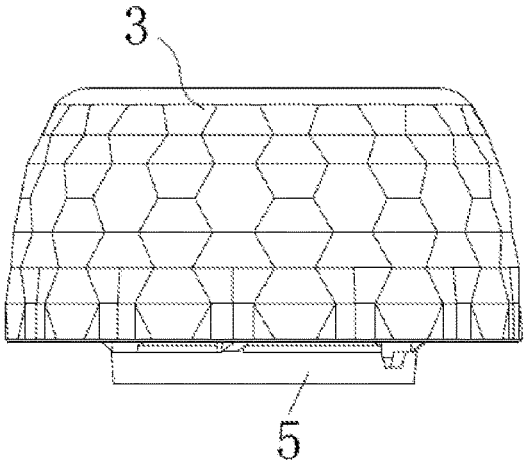
FIG. 5 is a front view of the seal cover of the present invention.
Figure 6:
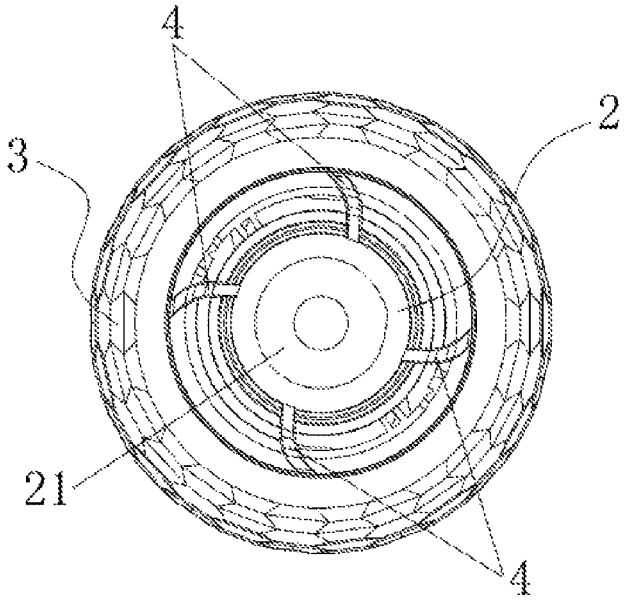
FIG. 6 is a top view of the seal cover of the present invention.
Figure 7:
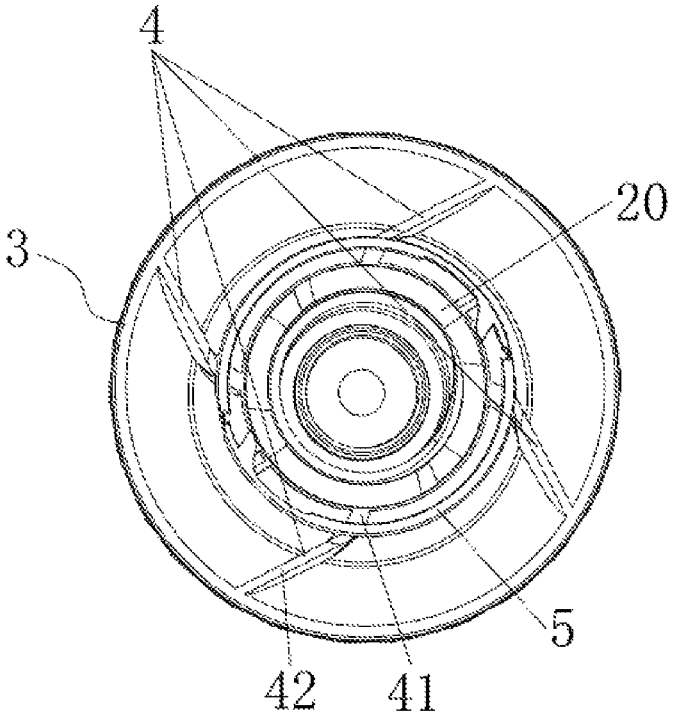
FIG. 7 is a bottom view of the seal cover of the present invention.
Figure 8:
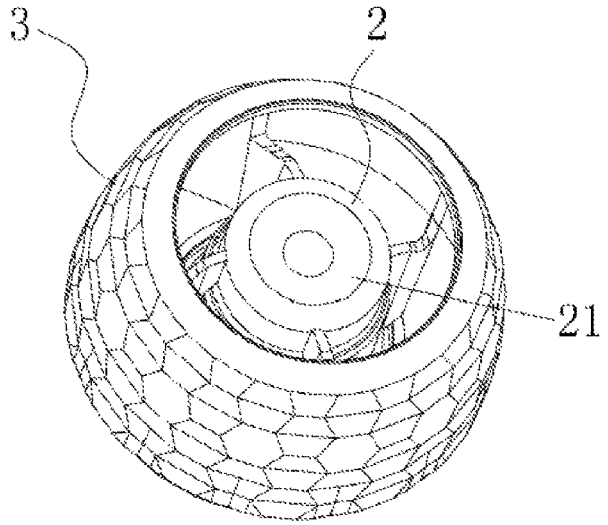
FIG. 8 is a top structure diagram of the seal cover of the present invention.
Figure 9:
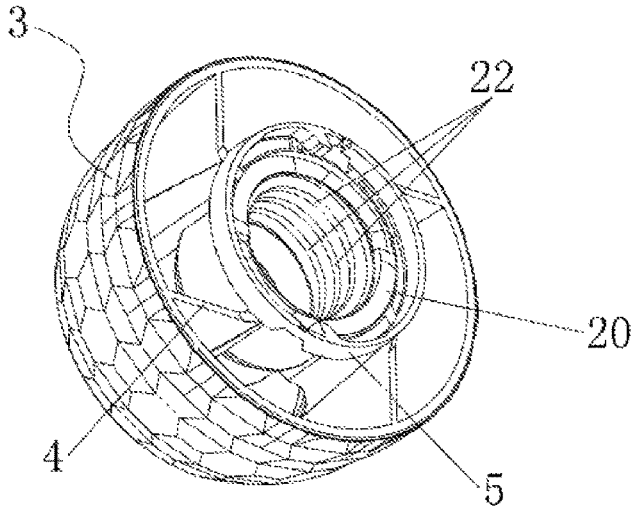
FIG. 9 is a bottom structure diagram of the seal cover of the present invention.

Referring to FIGS. 1-3, a filling tube 1 has a tube opening 10 at one end, and is connected to a hermetic container (not shown in the figures) at the other end. An outer wall of the filling tube 1 is provided with external threads 11, a broken ring 12 and a flange 13, wherein the external threads 11 are located between the tube opening 10 of the filling tube 1 and the broken ring 12, and the broken ring 12 is arranged along the perimeter of the outer wall of the filling tube 1 and located between the external threads 11 and the flange 13. The broken ring 12 is provided with a wedge block 14, and the external threads 11 are located between the tube opening 10 of the filling tube 1 and the wedge block 14. The wedge block 14 is formed by an arc surface 141 and a section 142 adjoined with the arc surface 141, wherein an arc mouth of the arc surface 141 faces away from the tube opening 10 of the filling tube 1, and the section 142 is perpendicular to the outer wall of the filling tube 1.

Referring to FIGS. 4-10, the seal cover includes an inner cover body 2 and an outer cover body 3.

The inner cover body 2 includes a cover wall 20 and a cover plate 21, the cover wall 20 enclosing a barrel structure, with one end sealed by the cover plate 21, and the other end being an open end. An inner surface of the cover wall 20 is provided with internal threads 22 matched with the external threads 11 of the filling tube 1. At the center of an inner surface of the cover plate 21 is provided a plug 23 which protrudes from the inner surface, and the plug 23 conforms to the shape of an inner wall of the tube opening 10 of the filling tube 1.

Figure 12:
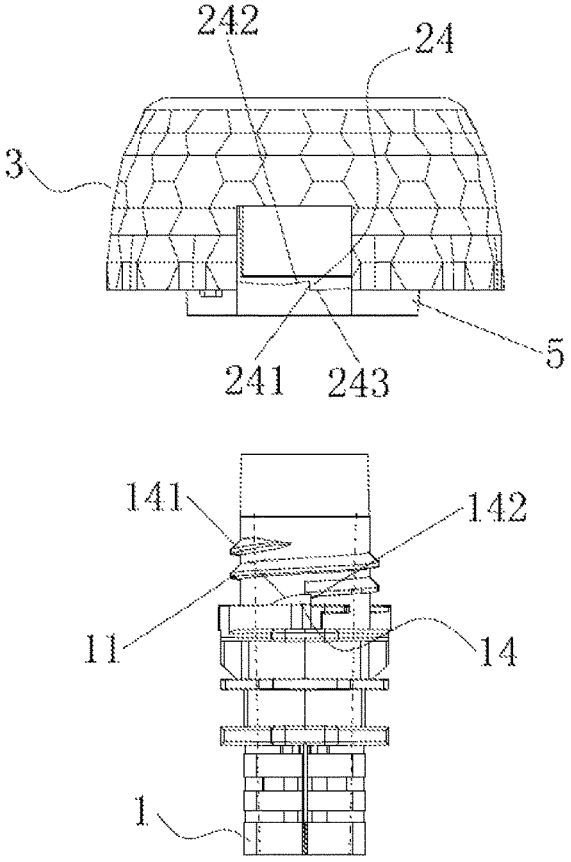
FIG. 12 is a front view of the seal cover of the present invention and the filling tube before being screwed with each other.
Figure 13:
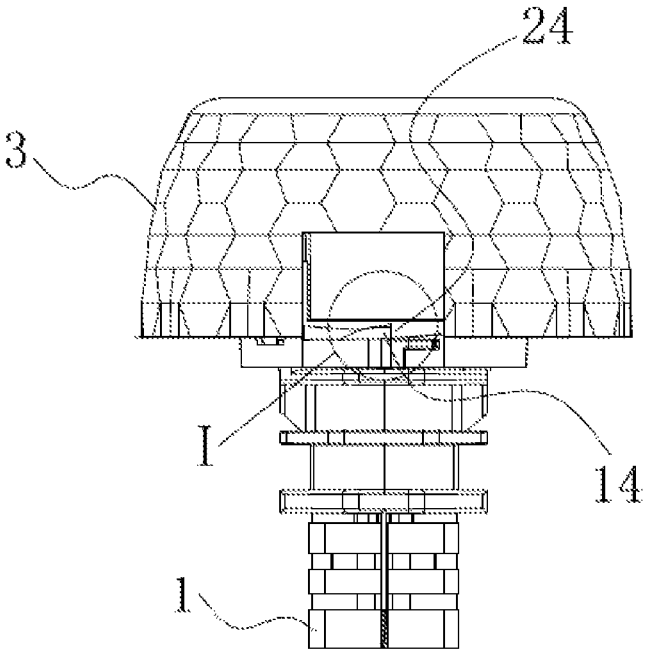
FIG. 13 is a front view of the seal cover of the present invention and the filling tube after being screwed with each other.
Figure 14:
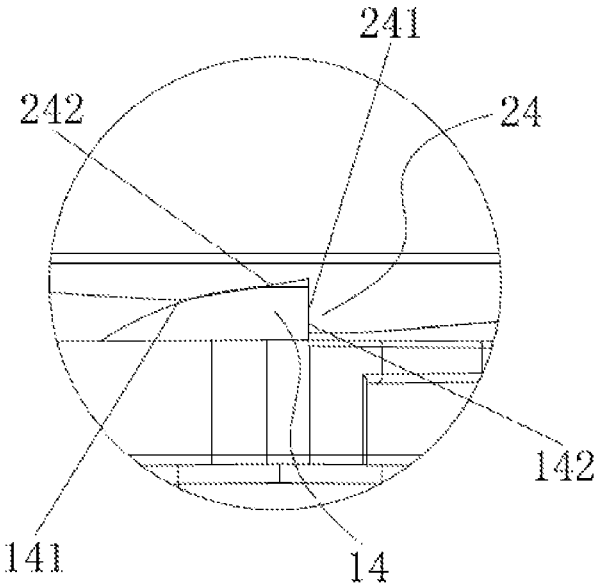
FIG. 14 is an enlarged view of a part I in FIG. 13.

Referring to FIGS. 11-16, the outer cover body 3 is partially cut away in FIGS. 12 and 13. A boss 24 is formed on an end face of the open end of the inner cover body 2; the boss 24 is formed by a cross section 241, and an oblique surface 242 and a step surface 243 which are adjoined with the cross section 241 respectively, the cross section 241 being perpendicular to the cover plate 21 and running through the wall thickness of the cover wall 20, the oblique surface 242 being tilted toward a direction away from the cover plate 21, and the step surface 243 protruding from the oblique surface 242. The oblique surface 242 and the section 241 are designed to form a V-shaped included angle, as shown in FIGS. 12-14.

The outer cover body 3 is a truncated-cone-like barrel structure, and is sleeved at the outer periphery of the inner cover body 2 and connected with the inner cover body 2. The diameter on the end of the outer cover body 3 close to the cover plate 21 is smaller than that on the end of the outer cover body close to the inner cover body 2. An outer wall surface of the outer cover body 3 is an arc curved surface, and is provided with continuous regular-hexagon patterns. The axis of the outer cover body 3 and the axis of the inner cover body 2 are collinear.

As shown in FIGS. 11-15, when the seal cover needs to be installed on the filling tube 1, first the open end of the inner cover body 2 is aligned with the tube opening 10 of the filling tube 1, then the external threads 11 of the filling tube 1 and the internal threads 22 of the inner cover body 2 are screwed with each other until the section 142 of the wedge block 14 is fit to and blocked by the cross section 241 of the boss 24, and the arc surface 141 of the wedge block 14 is closely fit to the oblique surface 242 of the boss 24 to stop rotation, and at this time, the filling tube 1 is just screwed tightly with the inner cover body 2, thus completing sealing of the tube opening 10 of the filling tube 1 by the inner cover body 2. When the inner cover body 2 is sealed at the tube opening 10 of the filling tube 1, the plug 23 of the inner cover body 2 is embedded in the tube opening 10 of the filling tube 1 to form a seal structure, and more preferably, and the plug 23 and the tube opening 10 of the filling tube 1 are in interference fit to achieve good sealing.

During screwing of the inner cover body 2 and the filling tube 1, the cross section 241 of the boss 24 blocks the section 142 of the wedge block 14, and the oblique surface 242 of the boss 24 and the arc surface 141 of the wedge block 14 clamp each other to produce an obvious sense of setback, which indicates the inner cover body 2 is already screwed tightly with the filling tube 1; and when the inner cover body 2 is being unscrewed from the filling tube 1, the oblique surface 242 separates from the arc surface 141 to produce an obvious sense of loosening and release, which indicates the inner cover body 2 is released from the filling tube 1. Thus, the boss 24 can serve to implement loosening and tightening functions at fixed points, to achieve the effect of indicating whether the seal cover is screwed tightly with or unscrewed from the filling tube 1, thereby facilitating a person or equipment accurately determining the position of the seal cover on the filling tube 1, avoiding the seal cover is not screwed in place, and also avoiding the seal cover is further rotated after arriving at a tightly screwed position; and in this way, the seal cover can be precisely screwed with the filling tube through the threads, and the sealing effect is ensured.

Second, after the inner cover body 2 is screwed tightly with the filling tube 1, the oblique surface 242 of the boss 24 and the arc surface 141 of the wedge block 14 clamp each other, so it can prevent the filling tube 1 from withdrawing from the inner cover body 2 under the action of an external force, avoid the inner cover body 2 and the filling tube 1 are gradually unscrewed and released from each other due to external vibration, and avoid the seal cover and the filling tube 1 are gradually unscrewed and released from each other due to vibration caused by transport, falling and other situations, thus improving the sealing reliability.

Furthermore, the cross section 241 of the boss 24 and the section 142 of the wedge block 14 abut against each other, so that the seal cover cannot be further rotated after arriving at the tightly screwed position, thereby overcoming a negative effect caused by torsion deviation. Although the magnitude of the torsion for rotating the seal cover may be different, it can ensure that the seal cover is screwed to the same tightly screwed position, thus improving the accuracy of screwing of the seal cover and the filling tube 1, and preventing cracking of the seal cover due to the action of the filling tube 1 on the seal cover.

According to actual need, there may be one, two or more bosses 24; accordingly, there may also be one, two or more wedge blocks 14, the number of which is equal to that of the bosses 24; and accordingly, there may also be one, two or more broken rings 12, the number of which is equal to that of the wedge blocks 14.

Figure 10:
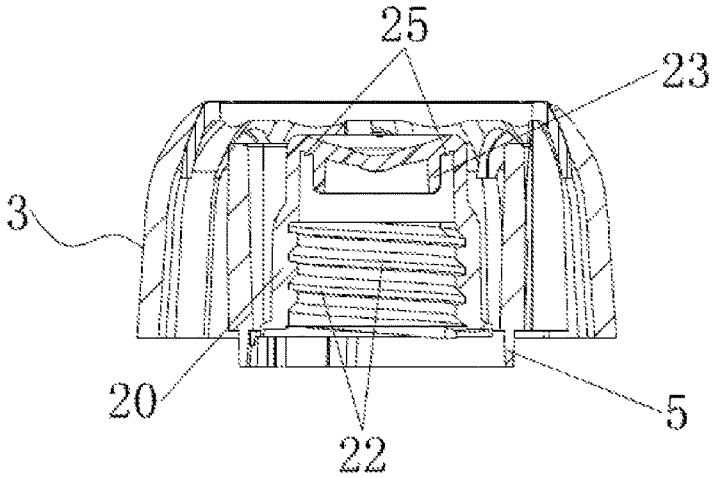
FIG. 10 is a sectional view of the seal cover of the present invention.
Figure 11:
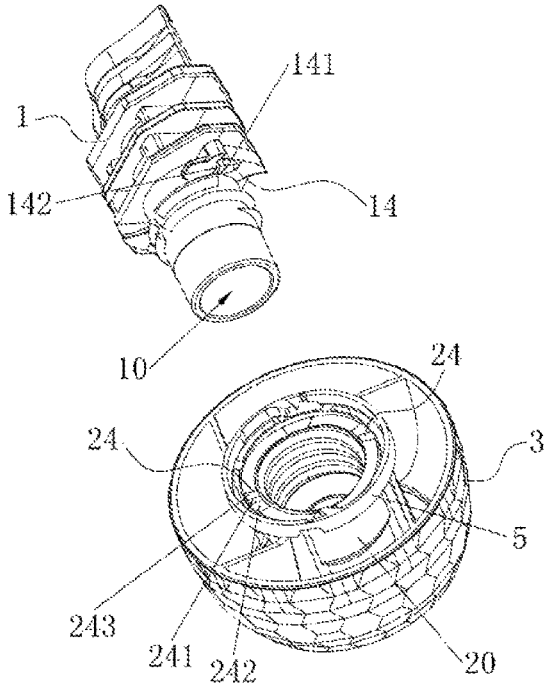
FIG. 11 is a three-dimensional structure diagram of the seal cover of the present invention and the filling tube before being screwed with each other.
Figure 15:
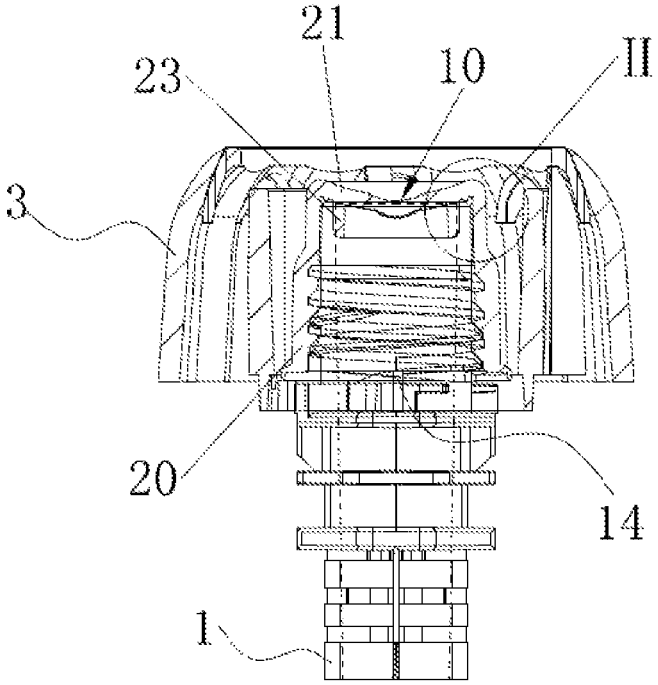
FIG. 15 is a sectional view of the seal cover of the present invention and the filling tube after being screwed with each other.
Figure 16:
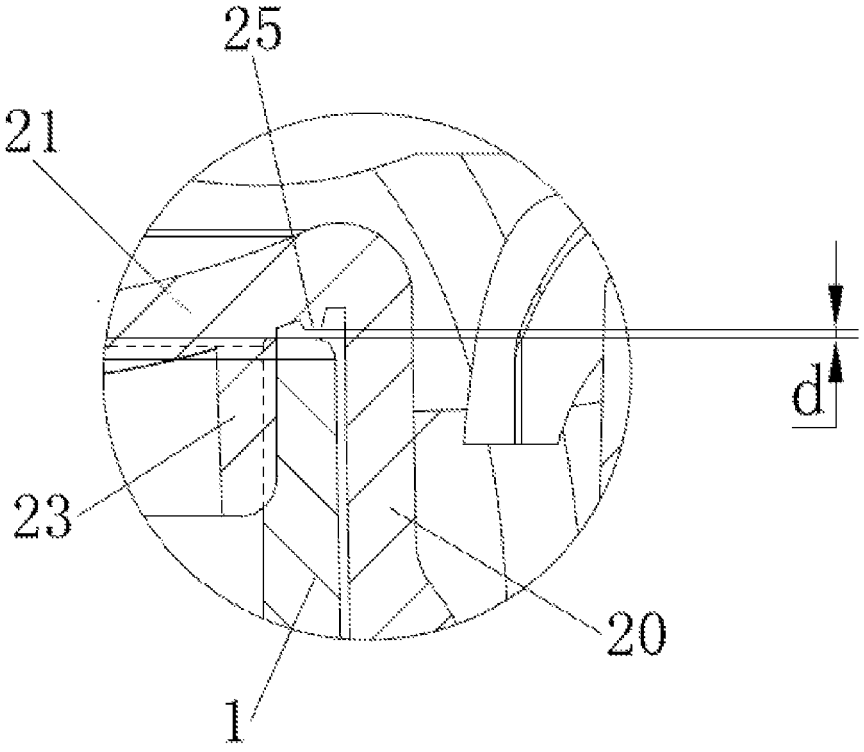
FIG. 16 is an enlarged view of a part II in FIG. 15.

To prevent friction between the wall end face of the filling tube 1 and the inner surface of the cover plate 21 during installation of the seal cover, it is defined that when the inner cover body 2 is sealed at the tube opening 10 of the filling tube 1, a clearance is present between the inner surface of the cover plate 21 and the wall end face of the filling tube 1, and the inner cover body 2 has an air pressure due to a small amount of gas retained therein, thereby reducing the acting force for resisting the external atmospheric pressure when unscrewing the filling tube 1 from the inner cover body 2. More preferably, as shown in FIGS. 10, 15 and 16, at least one convex point 25 is provided around the plug 23 in the inner surface of the cover plate 21, and when the filling tube 1 and the inner cover body 2 are just screwed tightly, a clearance d is present between the convex point 25 and the wall end face of the filling tube 1. If the filling tube 1 moves deeper in the inner cover body 2, the convex point 25 can block the wall end face of the filling tube 1, to avoid deformation or damage of the cover plate 21 in the case the wall end face of the filling tube 1 directly acts on the inner surface of the cover plate 21.

To improve the stability of connection between the inner cover body 2 and the outer cover body 3, and increase the balance of the entire seal cover structure, the inner cover body 2 and the outer cover body 3 are connected with each other through at least two connecting pieces 4.

More preferably, as shown in FIGS. 6-9, the inner cover body 2 and the outer cover body 3 are connected with each other through four connecting pieces 4. The four connecting pieces 4 are uniformly distributed at intervals around the inner cover body 2. Each connecting piece 4 is composed of an arc segment 41 and a straight segment 42 which are formed in one piece; opposite to an end of the arc segment 41 connected with the straight segment 42, the other end of the arc segment 41 is connected with the cover wall 20 of the inner cover body 2; opposite to an end of the straight segment 42 connected with the arc segment 41, the other end of the straight segment 42 is connected with the outer cover body 3; and the intersection point of extension lines of the arc segments 41 of all the connecting pieces 4 is located on the axis of the inner cover body 2. The four connecting pieces 4 form a spiral shape shown in FIG. 6, so that the seal cover can have special, attractive appearance on the one hand, and it can also achieve a guiding function on the other hand, to facilitate insertion of a rotating head of a filling and capping machine into the space between the inner cover body 2 and the outer cover body 3 during packaging.

To achieve an anti-theft function, the seal cover further includes an anti-theft ring 5 of an integrally formed structure, which is sleeved at the outer periphery of the open end of the inner cover body 2 and goes beyond the outer cover body 3. To increase the firmness of connection between the anti-theft ring 5 and the inner cover body 2, and also to improve the balance of the entire seal cover structure, the anti-theft ring 5 is connected to each connecting piece 4 respectively, specifically connected to the junction between the arc segment 41 and the straight segment 42 of each connecting piece 4 respectively.

The foregoing embodiments only represent several implementations of the present invention, and are described concretely in detail, but should not be understood for this reason to limit the patent scope of the present invention. It should be noted that for those of ordinary skill in the art, a number of modifications and improvements can be made without departing from the concept of the present invention, and all these modifications and improvements are encompassed within the protection scope of the present invention.

What is claimed is:

1. A seal cover for sealing a tube opening of a filling tube, comprising: an inner cover body and an outer cover body, wherein an outer wall of the filling tube is provided with external threads;

the inner cover body comprises a cover wall and a cover plate, wherein the cover wall encloses to form a barrel structure, a first end of the cover wall is sealed by the cover plate, and a second end of the cover wall is an open end; an inner surface of the cover wall is provided with internal threads matched with the external threads of the filling tube; a boss is formed on an end face of the open end of the inner cover body, and the boss is formed by a cross section, and an oblique surface and a step surface; the oblique surface and the step surface are adjoined to the cross section respectively, the cross section is perpendicular to the cover plate and runs through a wall thickness of the cover wall, and the oblique surface is tilted towards a direction away from the cover plate; the outer cover body is a barrel structure, and the outer cover body is sleeved at an outer periphery of the inner cover body and connected to the inner cover body;

the filling tube is provided with a wedge block, and the external threads on the outer wall of the filling tube are located between the tube opening and the wedge block; the wedge block is formed by an arc surface and a section adjoined to the arc surface, wherein an arc mouth of the arc surface faces away from the tube opening of the filling tube, and the section is perpendicular to the outer wall of the filling tube;

the external threads of the filling tube and the internal threads of the inner cover body are screwed with each other until the section of the wedge block is fit to and blocked by the cross section of the boss, and the arc surface of the wedge block is closely fit to the oblique surface of the boss; and the tube opening of the filling tube is sealed by the inner cover body;

wherein the seal cover further comprises an anti-theft ring sleeved at the outer periphery of the open end of the inner cover body, and the anti-theft ring is connected to the open end of the inner cover body and goes beyond the outer cover body.

2. The seal cover according to claim 1, wherein a plug protrudind from the inner surface is provided at a center of an inner surface of the cover plate of the inner cover body; and when the inner cover body is sealed at the tube opening of the filling tube, the plug is embedded in the tube opening of the filling tube to form a seal structure.

3. The seal cover according to claim 2, wherein the plug and the tube opening of the filling tube are in interference fit.

4. The seal cover according to claim 3, wherein when the inner cover body is sealed at the tube opening of the filling tube, a clearance is present between the inner surface of the cover plate and a wall end face of the filling tube.

5. The seal cover according to claim 3, wherein at least one convex point is provided around the plug in the inner surface of the cover plate.

6. The seal cover according to claim 1, wherein the inner cover body and the outer cover body are connected to each other through at least two connecting pieces, and the anti-theft ring is connected to each connecting piece.

7. The seal cover according to claim 6, wherein the each connecting piece is composed of an arc segment and a straight segment, and the arc segment and the straight segment are formed in one piece; a second end of the arc segment is opposite to a first end of the arc segment, wherein the first end of the arc segment is connected to the straight segment, and the second end of the arc segment is connected to the inner cover body; a second end of the straight segment is opposite to a first end of the straight segment, wherein the first end of the straight segment is connected to the arc segment, and the second end of the straight segment is connected to the outer cover body; and intersection points of extension lines of the at least two connecting pieces is located on an axis of the inner cover body.

8. The seal cover according to claim 7, wherein the anti-theft ring is connected to a junction between the arc segment and the straight segment of the each connecting piece.

9. A seal cover for sealing a tube opening of a filling tube, comprising: an inner cover body and an outer cover body, wherein an outer wall of the filling tube is provided with external threads;

the inner cover body comprises a cover wall and a cover plate, wherein the cover wall encloses to form a barrel structure, a first end of the cover wall is sealed by the cover plate, and a second end of the cover wall is an open end; an inner surface of the cover wall is provided with internal threads matched with the external threads of the filling tube; a boss is formed on an end face of the open end of the inner cover body, and the boss is formed by a cross section, and an oblique surface and a step surface; the oblique surface and the step surface are adjoined to the cross section respectively, the cross section is perpendicular to the cover plate and runs through a wall thickness of the cover wall, and the oblique surface is tilted towards a direction away from the cover plate: the outer cover body is a barrel structure, and the outer cover body is sleeved at an outer periphery of the inner cover body and connected to the inner cover body;

the filling tube is provided with a wedge block, and the external threads on the outer wall of the filling tube are located between the tube opening and the wedge block; the wedge block is formed by an arc surface and a section adjoined to the arc surface, wherein an arc mouth of the arc surface faces away from the tube opening of the filling tube, and the section is perpendicular to the outer wall of the filling tube;

the external threads of the filling tube and the internal threads of the inner cover body are screwed with each other until the section of the wedge block is fit to and blocked by the cross section of the boss, and the arc surface of the wedge block is closely fit to the oblique surface of the boss; and the tube opening of the filling tube is sealed by the inner cover body;

wherein an outer wall surface of the outer cover body is provided with continuous regular-hexagon patterns.

10. A seal cover for sealing a tube opening of a filling tube, comprising: an inner cover body and an outer cover bod wherein an outer wall of the filling tube is provided with external threads;

the inner cover body comprises a cover wall and a cover plate, wherein the cover wall encloses to form a barrel structure, a first end of the cover wall is sealed by the cover plate, and a second end of the cover wall is an open end; an inner surface of the cover wall is provided with internal threads matched with the external threads of the filling tube; a boss is formed on an end face of the open end of the inner cover body, and the boss is formed by a cross section, and an oblique surface and a step surface; the oblique surface and the step surface are adjoined to the cross section respectively, the cross section is perpendicular to the cover plate and runs through a wall thickness of the cover wall and the oblique surface is tilted towards a direction away from the cover plate: the outer cover body is a barrel structure, and the outer cover body is sleeved at an outer periphery of the inner cover body and connected to the inner cover body;

the filling tube is provided with a wedge block, and the external threads on the outer wall of the filling tube are located between the tube opening and the wedge block; the wedge block is formed by an arc surface and a section adjoined to the arc surface, wherein an arc mouth of the arc surface faces away from the tube opening of the filling tube, and the section is perpendicular to the outer wall of the filling tube;

the external threads of the filling tube and the internal threads of the inner cover body are screwed with each other until the section of the wedge block is fit to and blocked by the cross section of the boss, and the arc surface of the wedge block is closet fit to the oblique surface of the boss; and the tube opening of the filling tube is sealed by the inner cover body;

wherein a plug protrudind from the inner surface is provided at a center of an inner surface of the cover plate of the inner cover body; and when the inner cover body is sealed at the tube opening of the filling tube, the plug is embedded in the tube opening of the filling tube to form a seal structure;

wherein an outer wall surface of the outer cover body is provided with continuous regular-hexagon patterns.

11. The seal cover according to claim 3, wherein an outer wall surface of the outer cover body is provided with continuous regular-hexagon patterns.

12. The seal cover according to claim 4, wherein an outer wall surface of the outer cover body is provided with continuous regular-hexagon patterns.

13. The seal cover according to claim 5, wherein an outer wall surface of the outer cover body is provided with continuous regular-hexagon patterns.

14. The seal cover according to claim 1, wherein an outer wall surface of the outer cover body is provided with continuous regular-hexagon patterns.

15. The seal cover according to claim 6, wherein an outer wall surface of the outer cover body is provided with continuous regular-hexagon patterns.

16. The seal cover according to claim 7, wherein an outer wall surface of the outer cover body is provided with continuous regular-hexagon patterns.

17. The seal cover according to claim 8, wherein an outer wall surface of the outer cover body is provided with continuous regular-hexagon patterns.

* * * * *